US005320252A

United States Patent [19]

Fleming

[11] Patent Number: 5,320,252

[45] Date of Patent: Jun. 14, 1994

[54] LIQUID DISPENSING APPARATUS FOR DISPENSING A LIQUID UNDER PRESSURE FROM A CONTAINER BY MEANS OF PRESSURIZED FLUID

[76] Inventor: David B. R. Fleming, 77 Hamilton Avenue, Craighall Park, Johannesburg, Transvaal Province, South Africa

[21] Appl. No.: 875,801

[22] Filed: Apr. 30, 1992

[30] Foreign Application Priority Data

May 2, 1991 [ZA] South Africa ..... 91/3316

[51] Int. Cl.[5] ..... B05B 7/00

[52] U.S. Cl. ..... 222/145; 222/325; 222/630; 239/373

[58] Field of Search ..... 222/325, 630, 145; 239/373

[56] References Cited

U.S. PATENT DOCUMENTS

| | | | |
|---|---|---|---|
| 1,042,685 | 10/1912 | Kelly | 239/373 X |
| 2,982,478 | 5/1961 | Ball | 239/373 X |
| 3,756,513 | 9/1973 | Denninger | 239/337 |
| 4,116,382 | 9/1978 | Clerk | 239/373 X |
| 4,256,241 | 3/1981 | Mesic | 222/630 X |
| 4,386,634 | 6/1983 | Stasz et al. | 222/630 X |

FOREIGN PATENT DOCUMENTS

| | | |
|---|---|---|
| 027715 | 4/1981 | European Pat. Off. . |
| 87/1229 | 2/1987 | South Africa . |
| 87/1230 | 2/1987 | South Africa . |
| 87/1231 | 2/1987 | South Africa . |
| 416770 | 9/1934 | United Kingdom . |
| 416773 | 9/1934 | United Kingdom . |
| 483510 | 4/1938 | United Kingdom . |
| 493113 | 9/1938 | United Kingdom . |
| 534093 | 2/1941 | United Kingdom . |
| 627754 | 8/1949 | United Kingdom . |

*Primary Examiner*—Andres Kashnikow
*Assistant Examiner*—Lesley D. Morris
*Attorney, Agent, or Firm*—William Brinks Hofer Gilson & Lione

[57] ABSTRACT

The invention provides liquid dispensing apparatus arranged to dispense a liquid from a container by making use of a main water supply to pressurize the container. The invention also provides an aerosol valve for use with the liquid dispensing apparatus and configured such that when mounted on a container it permits the container to be pressurized with a gas and simultaneously permits a liquid to be dispensed from the container. Further, the invention provides a compressor arranged to provide a supply of compressed air by making use of a main water supply as the pumping fluid.

17 Claims, 11 Drawing Sheets

LIQUID DISPENSING APPARATUS FOR DISPENSING A LIQUID UNDER PRESSURE FROM A CONTAINER BY MEANS OF PRESSURIZED FLUID

FIELD OF THE INVENTION

THIS INVENTION relates to liquid dispensing apparatus. It also relates to an aerosol valve, to a method of providing a supply of compressed air and to a compressor suitable for use in the method.

SUMMARY OF THE INVENTION

According to one aspect of the invention there is provided liquid dispensing apparatus which includes an attachment for attachment sealingly to a vessel defining a pumping chamber and to a container containing liquid to be dispensed, the attachment including communication means for establishing gaseous communication between the pumping chamber and the container;

a discharge passage for conducting liquid from a said container to a discharge zone; and connecting means for connecting a supply of pumping fluid in flow communication with a said pumping chamber so as to feed pumping fluid into the pumping chamber and thereby displace air in the pumping chamber along the communication means into the container to pressurized the container and discharge the liquid contained in the container through the discharge passage.

The liquid dispensing apparatus may include pressure regulating means for regulating the pressure of pumping fluid entering the pumping chamber.

The attachment may comprise a body, a first adaptor mounted on the body for attachment to the vessel defining the pumping chamber, a second adaptor mounted on the body for attachment to the container containing liquid to be dispensed, an air flow passage extending through the body to connect the pumping chamber in gaseous communication with the container, a pumping fluid feed passage extending through the body and having an inlet which is connectable to a supply of pumping fluid and an outlet positioned to feed pumping fluid into the pumping chamber, the discharge passage extending through the body and having an inlet end through which liquid can enter the discharge passage and a discharge end.

The liquid dispensing apparatus may define a mixing zone for mixing liquid dispensed from a said container with a diluent.

The liquid dispensing apparatus may include a connecting passage extending through the body and connecting the pumping fluid feed passage in flow communication with the liquid discharge passage upstream of the discharge end of the liquid discharge passage, the intersection between the connecting passage and the liquid discharge passage defining said mixing zone.

The liquid dispensing apparatus may include dilution control means mounted in the vicinity of the mixing zone to permit adjustment of the degree of dilution of the liquid being dispensed. The dilution control means may comprise an adjustable gate mounted in the mixing zone to adjust the flow of pumping fluid flowing through the mixing zone.

In one embodiment of the invention the connecting means may include a connector mounted on the body and defining the inlet of the pumping fluid feed passage, the connector including a connecting formation whereby it is disconnectably connectable to a pumping fluid supply conduit.

In a preferred embodiment of the invention the liquid dispensing apparatus may be intended for use with water as the pumping fluid. The connecting formation will then preferably be of the type arranged click lockingly releasably to engage a complementary hose-pipe connector.

In another embodiment of the invention the connecting means may include a connector connected to the inlet of the pumping fluid feed passage by means of a flexible conduit.

The Applicant believes that the liquid dispensing apparatus will be particularly suitable for use in dispensing pesticides, herbicides and the like, the attachment then preferably being adapted for attachment sealingly to the container in which the liquid to be dispensed is supplied so as to obviate the need to transfer the liquid into a separate container and thereby reduce the risk of the liquid coming into contact with the skin of a user.

The container used with the liquid dispensing apparatus will typically incorporate a normally closed valve with the second adaptor being configured to displace the valve to its open position. Hence, when the container is mounted in engagement with the second adaptor the valve is opened permitting the container to be pressurized by means of air displaced from the pumping chamber and permitting the liquid to be dispensed from the container. When the container is disengaged from the second adaptor the valve returns to its closed position to prevent spillage of the liquid from the container. The Applicant believes that this will facilitate safe storage of the liquid since the container will be child-proof.

The connector may be a hose-pipe connector of the click-lock type which includes a body comprising a female member for releasable engagement with a complementary male fitting, and a male member connected to the female member for releasable engagement with a complementary female fitting, a flow passage extending through the female and male members.

The male member may extend at an obtuse angle relative to the female member. Hence, when the female member is connected to a tap via a said complementary male fitting and the male member is connected to a hose-pipe via a said complementary female fitting then the connector will pivot relative to the male fitting when the hose-pipe is pulled thereby reducing the load applied to the connector and hence the risk that it may be broken. In addition, this arrangement will improve the ground clearance of a connector mounted on a tap when compared to conventional connectors of which the Applicant is aware in which the male and female members are arranged in a straight line.

The pressure regulating means may be contained within the connector.

In one embodiment of the invention the body may include an intermediate portion connecting the male member to the female member with the pressure regulating means being provided in the intermediate portion.

The pressure regulating means may be adjustable to permit adjustment of the pressure to which the water flowing through the flow passage is regulated.

The regulating means may include a pair of opposed pistons mounted in the body intermediate the inlet and the outlet for reciprocation between rest positions in which they permit liquid flow through the body from the inlet to the outlet, and displaced positions in which they resist liquid flow through the body; and resilient bias means biassing the pistons in opposite directions towards their rest positions.

The pistons may be coaxial, one of the pistons being tubular and having a valve seat on a radially inner surface thereof, the other of the pistons having a tubular member an end portion of which is slidably and sealingly positioned within the one piston and a closure member connected to and spaced from the tubular member such that in the rest positions of the pistons the closure member is clear of the valve seat to permit liquid flow through the one piston and through the tubular member of the other piston and in the displaced positions of the pistons the closure member seats sealingly against the valve seat.

The resilient bias means may include at least one coil spring. In a preferred embodiment of the invention the resilient bias means includes two coil springs one of which acts on each of the pistons, the springs being mounted in compression in the body. The degree of pre-compression of the coil springs may be adjustable.

According to another aspect of the invention there is provided an aerosol valve which includes a housing which is mountable on an aerosol container and which defines an open-ended cylindrical cavity;

a tubular piston mounted with radial clearance in the cylindrical cavity for displacement between a normally closed position in which it prevents flow through the space between the piston and the housing and a displaced position in which it permits flow through the cavity in the space defined between the piston and the housing;

resilient bias means for biassing the piston resiliently towards its closed position;

a valve member mounted in the piston and displaceable between a rest position in which it prevents flow through the piston and an open position in which it permits flow through the piston; and urging means for urging the valve member towards its rest position.

The aerosol valve means may include an annular gasket mounted in the housing adjacent one end of the cylindrical cavity and having a hole therethrough which is in register with the opening at said one end of the cavity, the piston seating sealingly against the gasket in its closed position.

The piston may include a tailpiece which extends with clearance through the opening at the other end of the cavity, and to which a dip tube is connectable.

The housing may be of a composite construction comprising a mounting cup whereby it is mountable on an aerosol container, and a cylindrical sleeve defining the cylindrical cavity and on which the mounting cup is mounted.

According to yet another aspect of the invention there is provided a method of providing a supply of compressed air, which method includes the steps of introducing a pumping fluid into a pumping chamber to displace air contained within the pumping chamber; and feeding the air displaced from the pumping chamber by the pumping fluid into a compressed air reservoir.

The method may include repeatedly introducing pumping fluid into and discharging pumping fluid from the pumping chamber so as to feed air to the compressed air reservoir in an ongoing manner.

The method may include introducing pumping fluid into and discharging it from at least two pumping chambers connected in parallel and in flow communication with the reservoir.

Introducing pumping fluid into and discharging it from the pumping chambers preferably occurs out of phase, i.e. as pumping fluid is introduced into one pumping chamber, pumping fluid is discharged from the other pumping chamber and vice versa, so as to provide a substantially continuous supply of air from the pumping chambers to the reservoir.

The method may include regulating the pressure of the pumping fluid being introduced into each pumping chamber thereby to regulate the pressure of the air displaced from the pumping chamber.

The pumping fluid will typically be a liquid. In a preferred embodiment of the invention the pumping fluid may be water, the method then including connecting each pumping chamber to a pressurized water supply such as a main water supply. Hence, a domestic water supply can be used to provide a supply of compressed air.

According to still another aspect of ,the invention there is provided a compressor suitable for use in the above method which includes an air reservoir having an inlet and an outlet;

at least one pumping chamber having an air inlet which is open to atmosphere, an air outlet which is connected in flow communication with the inlet of the air reservoir, a pumping fluid inlet which is connectable in flow communication with a pressurized source of pumping fluid to permit pumping fluid to be introduced into the pumping chamber to displace the air contained within the pumping chamber through the air outlet into the air reservoir, and a pumping fluid outlet through which pumping fluid can be discharged from the pumping chamber; and valve means for regulating the flow of pumping fluid and air.

The valve means may be arranged such that when the pumping fluid inlet is open, i.e. when it is in flow communication with a source of pumping fluid, then the air outlet is opened and the pumping fluid outlet and the air inlet are closed, similarly, when the pumping fluid outlet is opened then the air inlet will also be opened and the pumping fluid inlet and air outlet will both be closed.

The compressor may include at least two pumping chambers, the air outlets of which are connected in parallel with the air reservoir, the valve means being arranged such that when the pumping fluid inlet of one of said pumping chambers is open then the pumping fluid outlet of the other of said pumping chambers is open and vice versa such that the pumping chambers operate out of phase and thereby provide a substantially continuous supply of compressed air to the compressed air reservoir.

Each pumping chamber may be in the form of a bottle, e.g. of a synthetic plastics material such as a so-called PET bottle. Similarly, the compressed air reservoir may be in the form of a bottle. The inlets and outlets may be incorporated into caps which are removably and sealingly mountable on the bottles.

The compressor may include a pressure regulator for regulating the pressure of the pumping fluid supplied to the or each pumping chamber and hence regulating the pressure of air supplied to the reservoir.

The pumping fluid may be water and the compressor may include a connector for connecting each pumping fluid inlet in flow communication with a pressurized water supply such as a main water supply. The pressure regulator may be integral with the connector.

The compressor may be provided in kit form with or without the bottles forming the pumping chambers and the compressed air reservoir.

BRIEF DESCRIPTION OF THE DRAWINGS

The invention will now be described, by way of example, with reference to the accompanying diagrammatic drawings.

In the drawings.

DESCRIPTION OF THE EMBODIMENTS

Figure 1:
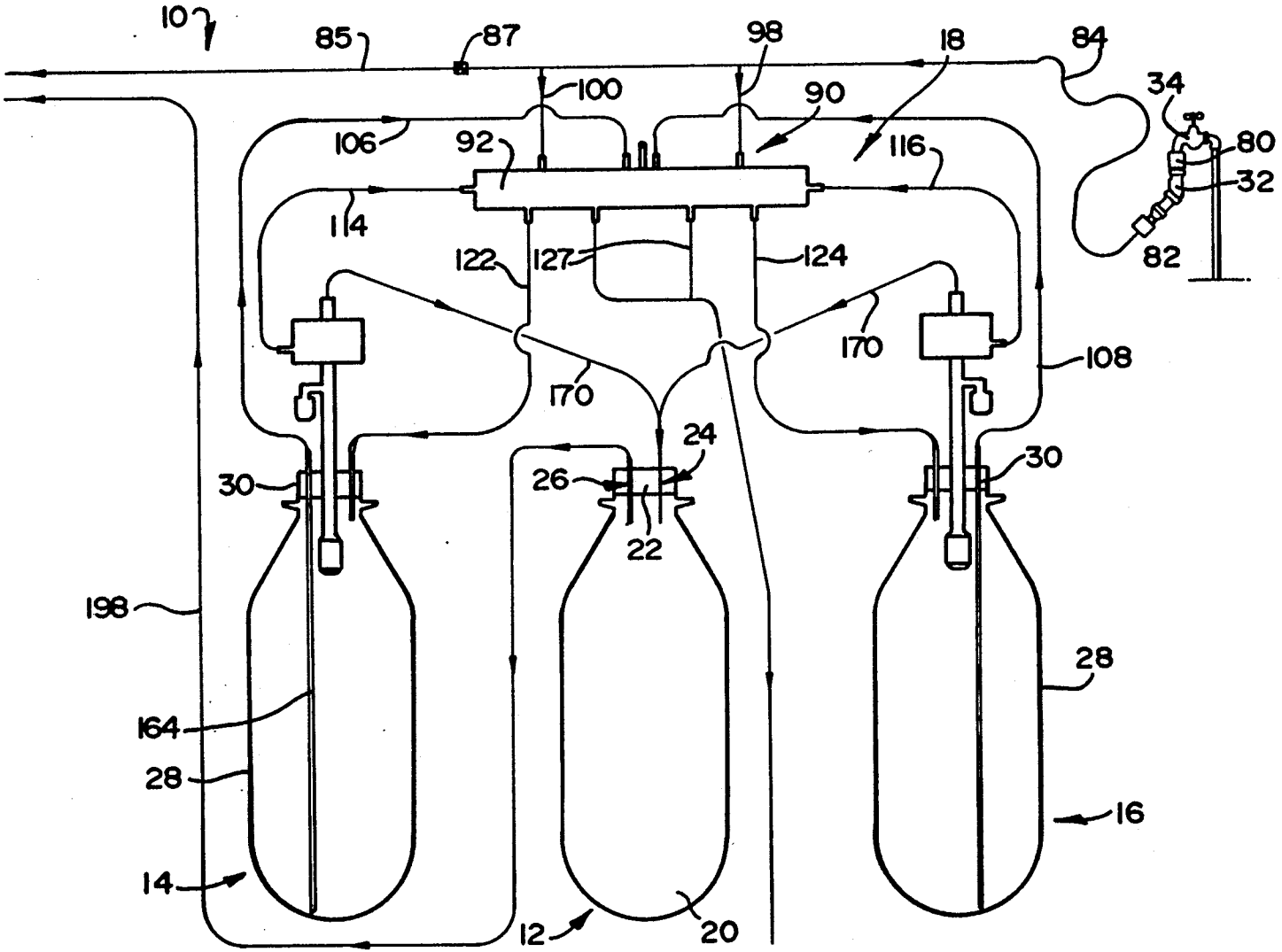
FIG. 1 shows schematically a compressor in accordance with the invention.

In FIGS. 1 to 6 of the drawings, reference numeral 10 refers generally to a compressor in accordance with the invention. The compressor 10 comprises a compressed air reservoir 12, a pair of pumping chambers 14, 16 and valve means, generally indicated by reference numeral 18.

The compressed air reservoir 12 comprises an open mouthed bottle 20 and a cap 22 which is screw-threadedly and sealingly mounted on the mouth of the bottle 20. The bottle 20 is typically of a synthetic plastics material and the Applicant has found that the so-called PET bottles which are used to contain carbonated beverages such as cold drinks and beer work satisfactorily. The bottles are currently available in 1,5 and 2 litre capacities. It is to be appreciated that bottles having different capacities could be used. A pair of openings extend through the cap 22, namely an inlet 24 and an outlet 26.

Similarly, the pumping chambers 14, 16 which are substantially identical each comprise a PET bottle 28 with a cap 30 being mounted screw-threadedly and sealingly on the mouth of the bottle 28.

The compressor 10 further includes a connector 32 for connecting the pumping chambers 14, 16 in fluid communication with a pressurized pumping fluid supply which, in the embodiment shown, is a main water supply illustrated by a tap 34.

Figure 2:
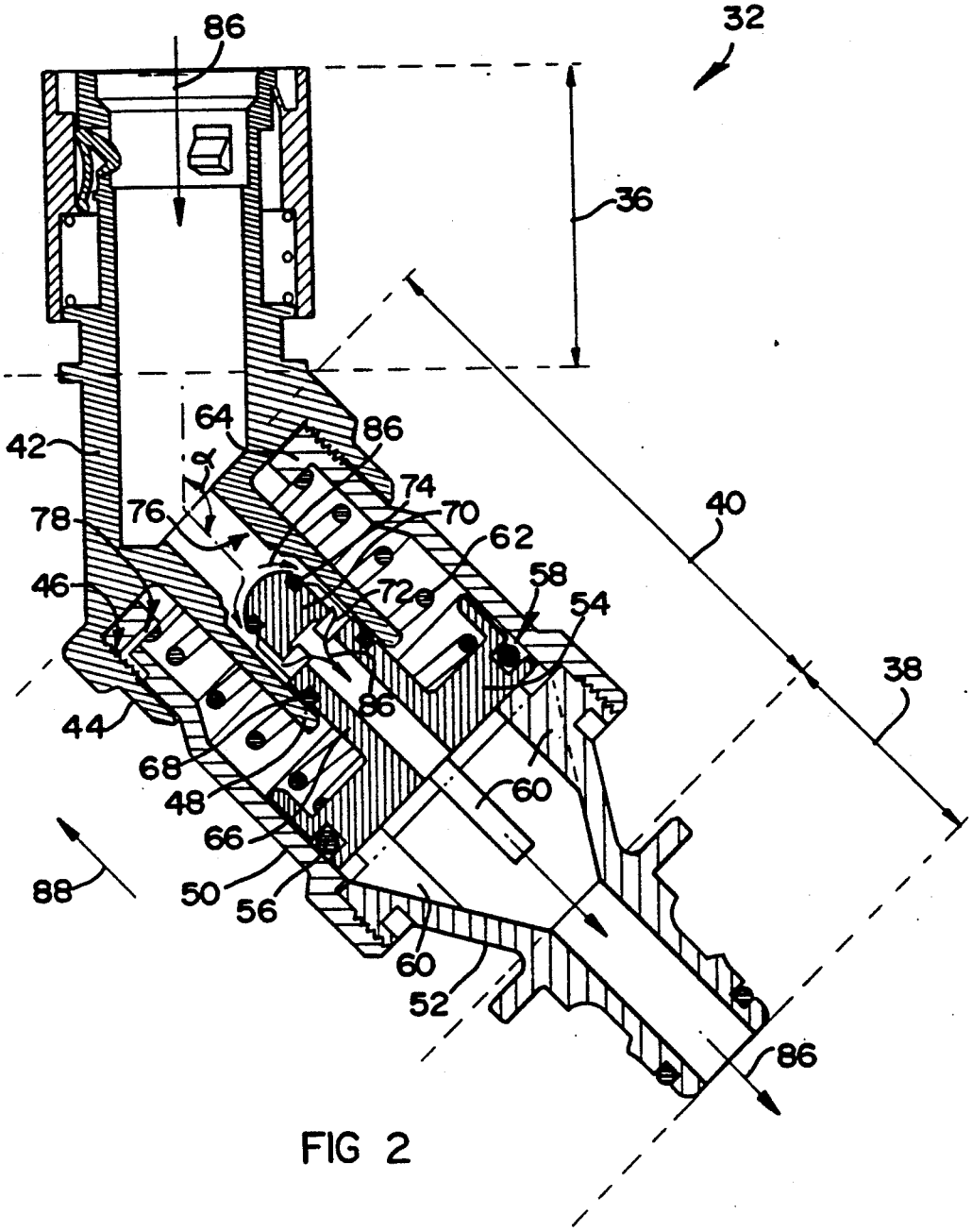
FIG. 2 shows a sectional elevation of a connector forming part of the compressor of FIG. 1.
Figure 3:
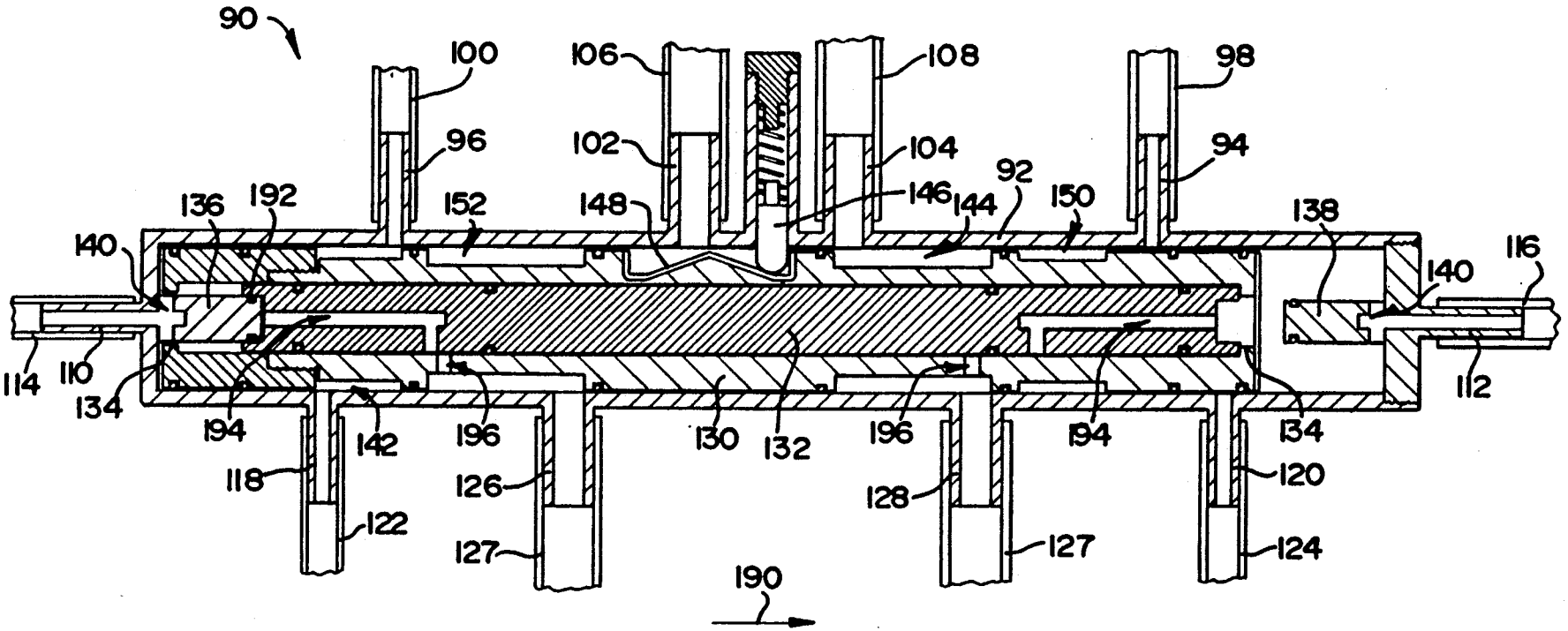
FIG. 3 shows a sectional elevation of a shuttle valve forming part of the compressor of FIG. 1.

As can best be seen in FIG. 2 of the drawings, the connector 32 comprises a female member 36, a complementary male member 38 and an intermediate portion 40 connecting the male member 38 to the female member 36 at an obtuse angle $\alpha$. The female member 36 and male member 38 are similar to the click-locking type of garden irrigation fittings which are available under the trade marks "Hozelock" or "Gardena" and which are arranged click-lockingly releasably to engage complementary male and female fittings, respectively. The intermediate portion 40 comprises a connecting piece 42 one end of which is fast with the female member 36 and from the other end of which an annular collar 44 depends at the angle $\alpha$. A female screw-thread 46 is provided on the radially inner surface of the annular collar 44. A cylindrical tubular member 48 which is of smaller diameter and coaxial with the annular collar 44 protrudes from the connecting piece 42. A sleeve 50 is screw-threadedly connected at its one end to the collar 44 with the male member 38 being screw-threadedly connected to its other end via a tapered bridge piece 52.

A piston 54 is slidably mounted with little clearance in the sleeve 50. A seal in the form of an O-ring 56 is mounted in a complementary annular recess 58 on the piston 54, the O-ring 56 sealingly engaging the radially inner surface of the sleeve 50. The piston 54 is displaceable between a rest position (shown in FIG. 2 of the drawings) in which it abuts a plurality of circumferentially spaced stops 60 protruding radially inwardly from the bridge piece 52, and a displaced position in which it is clear of the stops 60. Resilient bias means in the form of a coil spring 62 is mounted in compression between the piston 54 and a shoulder 64 protruding radially inwardly from the sleeve 50 to urge the piston 54 towards its rest position. The piston 54 includes a tubular protrusion 66 which is positioned slidably within the tubular member 48. A seal in the form of an O-ring 68 positioned in a complementary annular recess in the protrusion 66 sealingly engages the radially inner surface of the tubular member 48.

A closure member 70 is connected via a plurality of circumferentially spaced arms 72 to the free end of the protrusion 66 such that it is spaced therefrom. An O-ring 74 is provided in a complementary annular recess in the closure member 70, the closure member 70 being dimensioned such that it fits with clearance in the tubular member 48 when the piston 54 is in its rest position. The radially inner surface of tubular member 48 is stepped approximately midway along its length with the upstreamportion of the tubular member 48, ie the portion closest to the connecting piece 42, being of smaller diameter than the downstream portion and forming a valve cylinder 76. The valve cylinder 76 is dimensioned such that the O-ring 74 is slidably and sealingly receivable therein when the piston 54 is in its displaced position.

A bleed passage 78 is provided in the sleeve 50 and shoulder 64 to permit the flow of air into and out of the cavity defined between the radially inner surface of the sleeve 50, the radially outer surface of the tubular member 48 and the piston 54.

In use, the female member 36 will be connected to a complementary male fitting 80 (FIG. 1) connected to the tap 34. Similarly, a hose-pipe 84 will be connected to the male member 38 via a complementary female fitting 82 (FIG. 1).

In use, water will flow through the connector 32 in the direction of arrows 86. However, due to the large area of the piston 54 on which water contained within the bridge-piece 52 acts in comparison with the relatively small area on which water contained within the tubular member 48 acts the piston will tend to be displaced in the direction of arrow 88, i.e. against the bias of the spring 62. The spring 62 will be selected such that if the water pressure within the bridge-piece 52 exceeds the pressure required, the piston 54 is displaced sufficiently far in the direction of arrow 88 that the O-ring 74 seats sealingly within the valve cylinder 76 thereby temporarily blocking the flow of water through the connector 32. When the water pressure within the bridge-piece 52 returns to or falls below the required water pressure the piston will be displaced under the action of the spring 62 in a direction opposite to that of arrow 88 thereby once again permitting the flow of water through the connector 32. The pressure to which the connector 32 limits water flowing therethrough can be adjusted by rotating the sleeve 50 relative to the annular collar 44 and thereby adjusting the relative spacing between the seal 74 and the valve cylinder 76 thereby adjusting the distance which the piston must be displaced in order for the seal 74 to seat sealingly within the valve cylinder 76. This in turn adjusts the degree of compression of the spring 62 and hence the pressure required within the bridge-piece 52 to displace the piston sufficiently far to interrupt the flow of water through the connector 32.

If desired, the connector 32 can be configured such that the sleeve 50 can be screwed sufficiently far into the annular collar 44 so that the O-ring 74 is positioned sealingly within the valve cylinder 76 even when the piston S4 is in its rest position thereby to prevent the flow of water through the connector 32.

The female member 36 and male member 38 are arranged at the angle $\alpha$ such that if a load is applied to the connector 32 by pulling on the hose-pipe 84 the connector will tend to swivel about its connection with the male fitting 80 such that the male member 38 protrudes from the female member 36 in the direction in which the hose-pipe 84 extends. The Applicant believes that this will reduce the load applied to the connector and to the hose-pipe connection to the connector and reduce the risk that the hose-pipe connection and/or the connector may be broken by pulling on the hose-pipe 84. It is, however, to be appreciated that if desired the female member 36 and male member 38 could be arranged in a straight line.

As can be seen in FIG. 1 of the drawings, the hose-pipe 84 is connected to a shuttle valve, generally indicated by reference numeral 90 which forms part of the valve means 18. As can best be seen in FIG. 3 of the drawings, the shuttle valve 90 comprises a generally cylindrical housing 92 having a pair of water inlets 94, 96 connected to the hose-pipe 84 via conduits 98, 100, respectively. The shuttle valve 90 further includes a pair of water siphon inlets 102, 104 connected in flow communication via conduits 106, 108 with pumping fluid outlets of the pumping chambers 14, 16, respectively. The housing 92 further includes air inlets 110, 112 which are connected via pipes 114, 116 in flow communication with the pumping chambers 14, 16, respectively. The housing further includes a pair of water outlets 118, 120 connected via pipes 122, 124 with pumping fluid inlets of the pumping chambers 14, 16, as described in more detail herebelow. The housing 92 also includes a pair of water siphon outlets 126, 128.

The shuttle valve 90 includes an outer tubular piston 130 which is slidably mounted within the housing 92 and an inner piston 132 which is slidably mounted in the outer piston 130 and is retained captive therein by means of shoulders 134 protruding radially inwardly from the ends of the outer piston 130. Spacer members 136, 138 protrude axially inwardly from opposite ends of the housing 92. The spacer members 136, 138 are dimensioned such that they pass with clearance through the apertures defined by the shoulders 134. Each of the spacer members 136, 138 has a passage 140 connecting the air inlets 110, 112 in flow communication with the interior of the housing 92.

The outer piston 130 is longitudinally displaceable within the housing 92 between a first position (shown in FIG. 3 of the drawings) in which the water inlet 96 is in flow communication with the water outlet 118 via an annular recess 142 in the piston 130. Further, in the first position of the piston 130 the water siphon inlet 104 is in flow communication with the water siphon outlet 128 via an annular recess 144 in the piston 130. The piston 130 is retained releasably in its first position by means of a spring loaded cam follower 146 acting on a cam 148 forming part of the piston 130. Similarly, in the second position of the piston 130 the water inlet 94 will be in flow communication with the water outlet 120 via an annular recess 150 in the piston 130 and the water siphon inlet 102 will be in flow communication with the water siphon outlet 126 via an annular recess 152 in the piston 130. The outer piston 130 is displaced between its first and second positions by means of air pressure as described in more detail herebelow.

If desired the connector 32 can be connected to the shuttle valve 90 or liquid dispensing apparatus of the type described in detail hereunder at the point of entry of the water supply. This enables the water pressure to be regulated or shut off more readily than if connector 32 is connected to a tap as shown.

Figure 4:
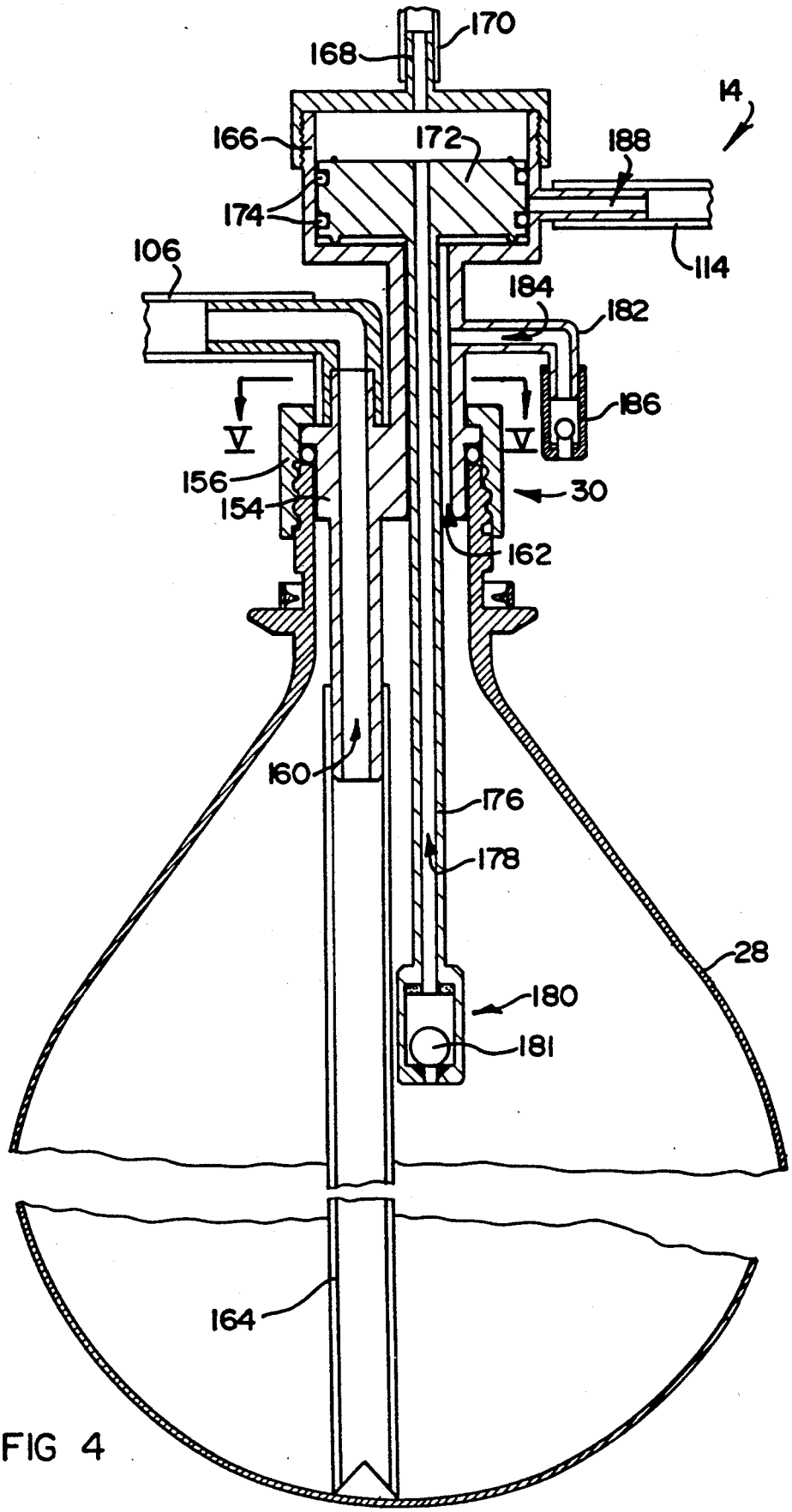
FIG. 4 shows a sectional elevation taken at IV—IV in FIG. 5 of a pumping chamber forming part of the compressor of FIG. 1.
Figure 5:
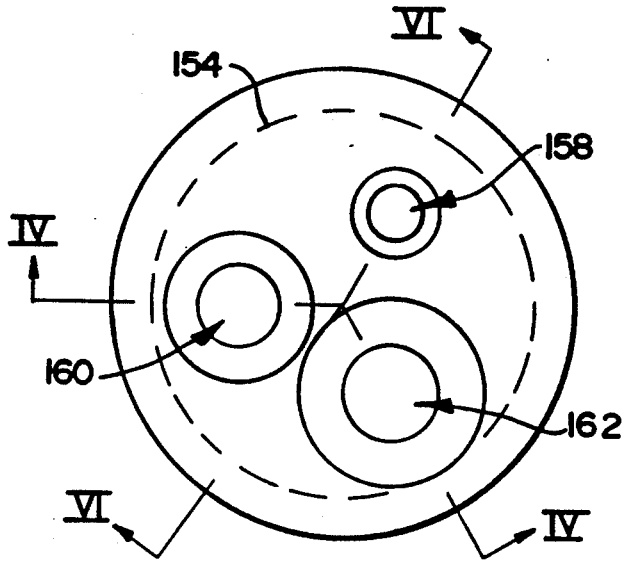
FIG. 5 shows a sectional elevation taken at V—V in FIG. 4.
Figure 6:
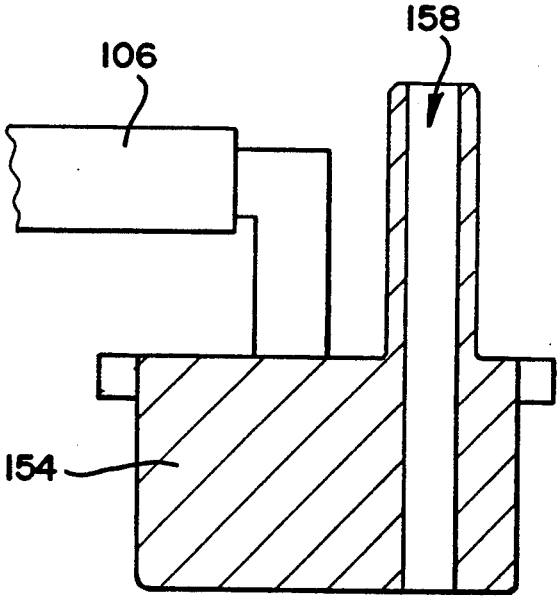
FIG. 6 shows a sectional elevation taken at VI—VI in FIG. 5.
Figure 7:
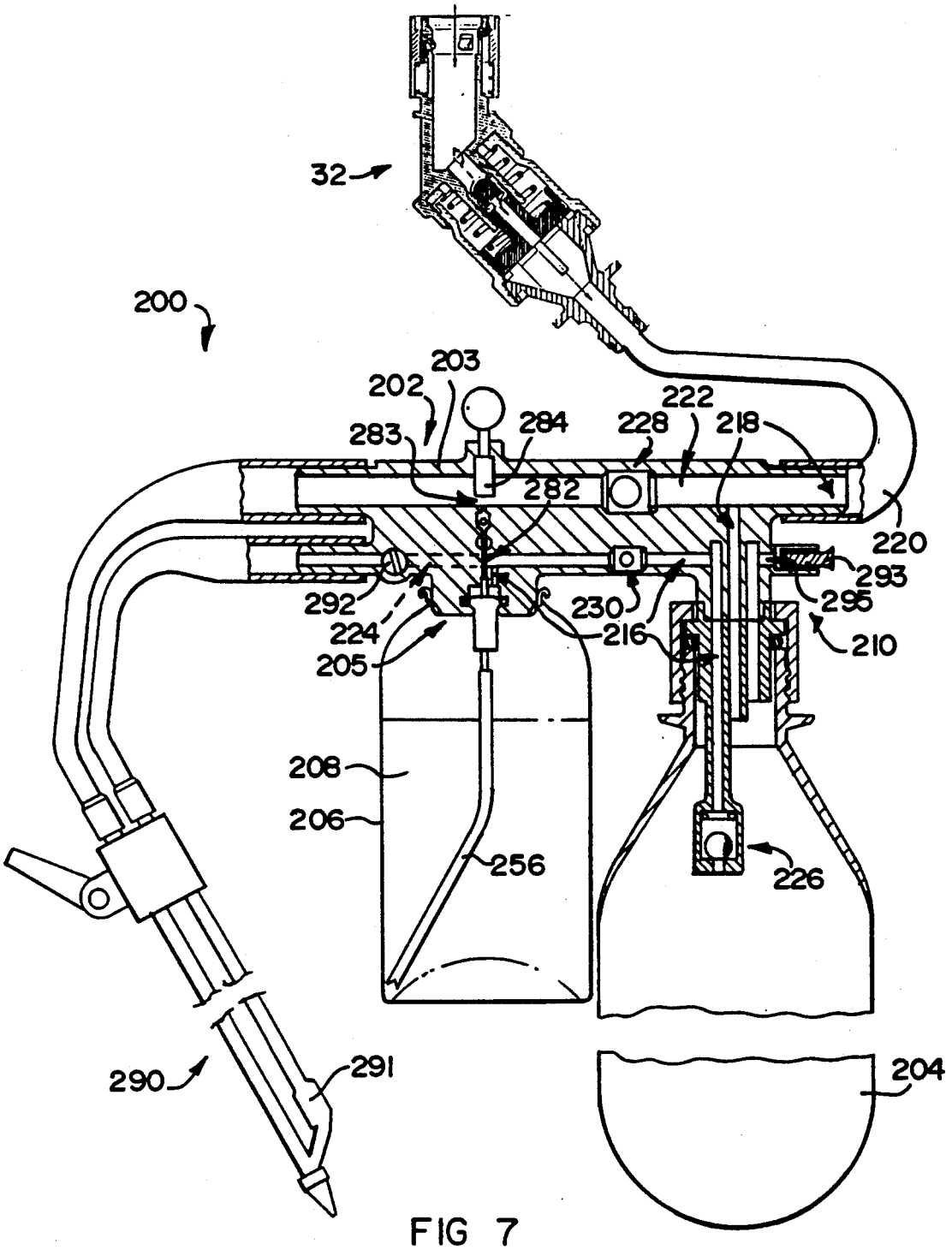
FIG. 7 shows a partially sectioned schematic view of liquid dispensing apparatus in accordance with the invention.

As can best be seen in FIGS. 4, 5 and 6 of the drawings, the cap 30 mounted on the bottle 28 of the pumping chamber 14 is of composite construction and comprises a body 154 and a retaining element 156 which is screw-threadedly mounted on the threaded neck of the bottle 28 to retain the body 154 in position. The body 154 includes three passages 158, 160, 162 extending therethrough. The passage 158 (FIGS. 5 and 6) defines a pumping fluid inlet which is in flow communication with the water outlet 118 via the pipe 122. The passage 160 defines a pumping fluid cutlet and is connected via conduit 106 to the water siphon inlet 102. A dip-tube 164 which extends to the bottom of the bottle 28 is connected in flow communication with the passage 160. The passage 162 provides both an air inlet and an air outlet. The upper end of the passage 162 opens into the lower end of a cylinder 166. An air outlet 168 opens out of the upper end of the cylinder 166 and is connected in flow communication with the inlet of the bottle 20 via a pipe 170. A piston 172 is mounted for reciprocation in the cylinder 166 with a pair of o-rings 174 being provided in complementary annular recesses in the piston 172 and sealingly engaging the cylinder 166. A stem 176 is connected to the piston 172 and extends through the passage 162 into the bottle 28. A passage 178 extends through the stem 176 and piston 172. A float actuated valve 180 is provided at the lower end of the stem 176, the function of which is described in more detail herebelow.

The air inlet is formed by a tubular member 182 defining an inlet passage 184 which is in flow communication with the passage 162 below the cylinder 166. A normally closed non-return valve 186 is provided at the free end of the tubular member 182. A discharge passage 188 extends out of the side of the cylinder 166 and is connected via a pipe 114 in flow communication with the air inlet 110. When the piston 172 is in its rest position (shown in FIG. 4 of the drawings) the O-rings 174 are positioned on opposite sides of the discharge passage 188 thereby effectively isolating it from the interior of the bottle 28.

The pumping chamber 16 is substantially identical to the pumping chamber 14, except that its passage 158 is connected to the water outlet 120 via the pipe 124. Further, its passage 160 is connected via conduit 108 to the water siphon inlet 104. Its air outlet 168 is connected in flow communication with the reservoir 20. In addition, its discharge passage 188 is connected via a pipe 116 in flow communication with the air inlet 112.

In use, with the piston 130 of the shuttle valve 90 in its first position (shown in FIG. 3 of the drawings) water is fed from the tap 34 through the hose-pipe 84 and conduit 100, through the water inlet 96 and out the water outlet 118, through the pipe 122 and the passage 158 into the bottle 28. As the bottle 28 fills with water air contained within the bottle is displaced by the water and flows through the passage 178 through the pipe 170 into the reservoir 20. When the water level in the bottle 28 reaches the valve 180, the valve 180 is closed by the floating of the ball 181 thereby preventing further flow of air through the passage 178. As the water level continues to rise and the air in reservoir 20 is consumed thus causing the pressure in reservoir 20 to drop the remaining air within the bottle 28 is at a higher pressure than that in reservoir 20 such that the force acting on the underside of the piston 172 is greater than the force acting on the top of the piston 172 which causes the piston to be raised. As the lowermost O-ring 174 passes the discharge passage 188 air contained within the bottle 28 flows through the passage 162 and discharge passage 188 into the air inlet 110. As a result of the air pressure acting on the end of the outer piston 130 it is displaced within the housing 92 in the direction of arrow 190. Initially the inner piston 132 remains stationary with its one end sealingly engaging the spacer member 136 via an O-ring 192. However, when the adjacent shoulder 134 engages the end of the inner piston 132 it is displaced together with the outer piston 130 in the direction of arrow 190. As the end of the inner piston 132 clears the O-ring 192 the air inlet 110 is connected in flow communication with the water-outlet 126 via a passage 194 extending through the inner piston 132 and a complementary passage 196 extending through the outer piston 130 which causes compressed air contained in the air inlet 110 to be exhausted to atmosphere so that the pressure in the air inlet 110 is reduced to ambient pressure. By this stage the outer piston 130 has moved sufficiently far in the direction of arrow 190 that the cam 148 has passed its halfway mark. The cam slopes downwardly and outwardly from its centre such that when the cam passes its halfway mark the cam follower 146 urges the outer piston 130 in the direction of arrow 190 into its second position. This further displacement of the outer piston 130 brings the water siphon inlet 102 into flow communication with the water siphon outlet 126. Simultaneously it brings the water inlet 94 into flow communication with the water outlet 120 causing water from the tap to be directed to the other pumping chamber 16.

At the same time pressure within the bottle 28 of the pumping chamber 14 causes water contained therein to be displaced along the dip tube 164, passage 160, conduit 106 into the water siphon inlet 102. The water flows around the recess 152 and is discharged through the water-outlet 126 into a conduit 127, the free end of which is positioned at a level which is lower than the bottle 28 so that the water flows out of the bottle under a siphon action. As the water level in the bottle 28 decreases the non-return valve 186 is opened permitting air to be drawn into the bottle 28. At the same time, the ball 181 serves to close the passage 178 and prevent the discharge of compressed air from the bottle 20 back into the bottle 28.

When the bottle 28 of the pumping chamber 16 becomes full the procedure is repeated with air being fed through the air inlet 112 to displace the outer piston in a direction opposite to the direction of arrow 190. This procedure is repeated cyclically so as to provide a more or less continuous supply of compressed air to the air reservoir 12. A conduit 198 leads from the air reservoir to an end user.

If the air reservoir 12 becomes full, i.e. the pressure of the air contained within the reservoir 12 is at the maximum desired pressure then an equilibrium state is reached where the air pressure within the bottle 28 being filled with water equals the water pressure. The flow of water into the bottle 28 will then be temporarily interrupted until such time as air is used thereby reducing the air pressure in the reservoir 12.

The Applicant believes that a compressor in accordance with the invention will be easy to use and will convert the pressure of a domestic water supply into a substantially continuous supply of compressed air.

The Applicant believes that the supply of compressed air can be used for any number of applications. These include, for example, to pressurize a container within which a carbonated beverage such as a soft drink or beer is kept in order to maintain the required carbonation level. In addition, the compressed air supply could be used together with a suitable connector to inflate vehicle tires. Further, it could be used to aerate the water in swimming pools, fish ponds and the like, it could also be used together with a pressurized water supply in order to provide an atomised spray. To this end, a supply pipe 85 (FIG. 1 of the drawings) may be connected via a manually operable valve 87 to the hose-pipe 84 thereby to provide a water supply the pressure of which is regulated by means of the connector 32 and which pressure is equal to the pressure of the air in the reservoir 12.

Figure 11:
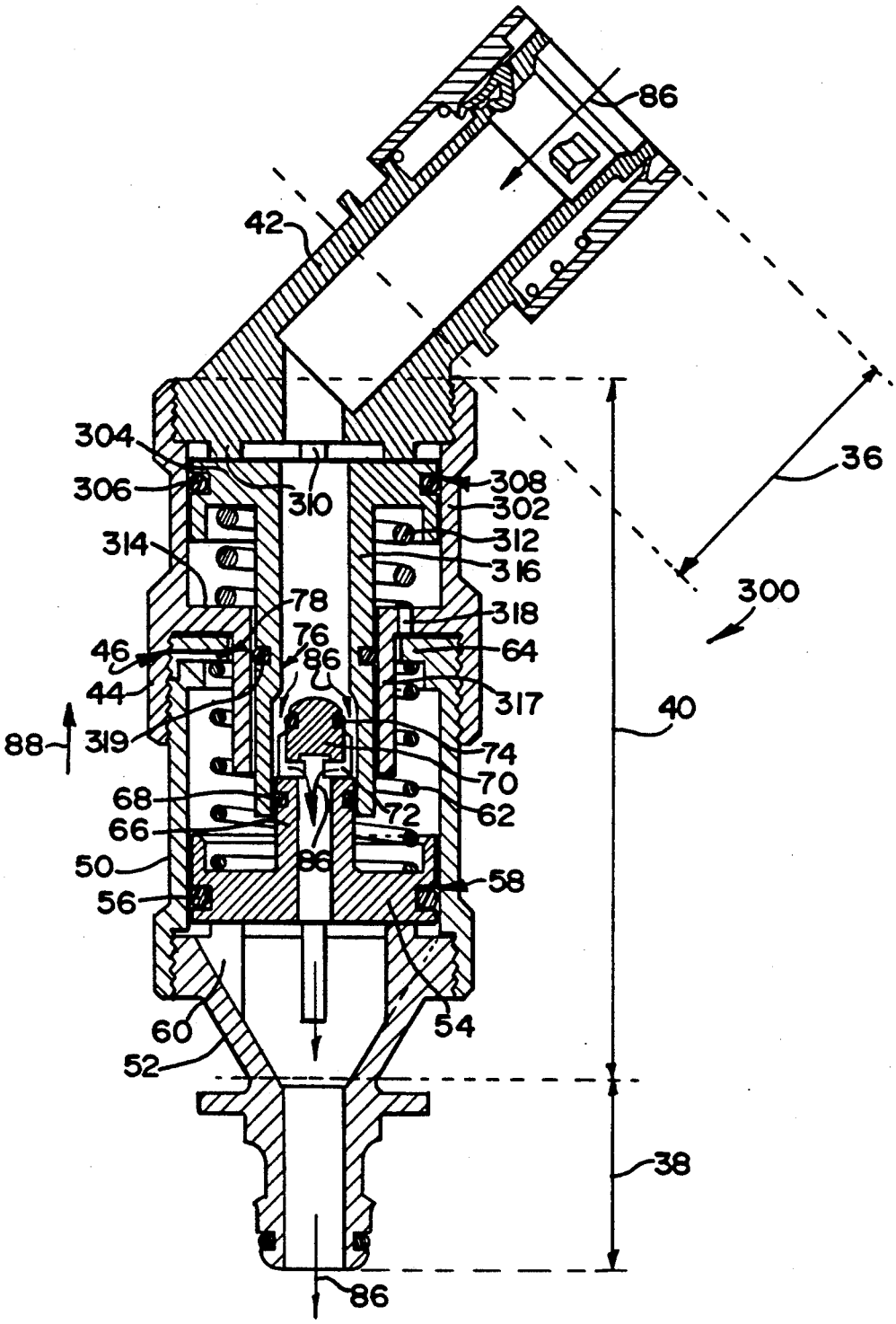
FIG. 11 shows a sectional elevation similar to FIG. 2 of a pressure regulator in accordance with the invention.

Reference is now made to FIG. 11 of the drawings where reference numeral 300 refers generally to another connector or regulator in accordance with the invention. The connector 300 is similar to the connector 32 described above with reference to FIG. 2 of the drawings, and, unless otherwise indicated, the same reference numerals used above are used to designate similar parts. In the connector 300 the sleeve 50 is connected to the connecting piece 42 by means of a generally cylindrical extension piece 302 which is screw-threadedly connected at its one end to the connecting piece 42 and at its other end to the sleeve 50. The piston 54 is substantially identical to the piston 54 of the connector 32 and is mounted for reciprocation in the sleeve 50. The connector 300 includes another piston 304 which is generally T-shaped in diametral cross-section and which is mounted for reciprocation in the extension piece 302. A seal in the form of an O-ring 306 is mounted in a complementary annular recess 308 in the piston 304, the O-ring 306 sealingly engaging the radially inner surface of the extension piece 302. The piston 304 is displaceable between a rest position (shown in FIG. 11 of the drawings) in which it abuts a plurality of circumferentially spaced stops 310 fast with the connecting piece 42, and a displaced position in which it is clear of the stops 310.

Resilient bias means in the form of a coil spring 312 is mounted in compression between the piston 304 and a shoulder 314 protruding radially inwardly from the extension piece 302 adjacent its connection with the sleeve 50. The piston 304 is tubular and coaxial with the piston 54 and includes a circular cylindrical tubular axially extending protrusion 316 which extends with clearance through the shoulder 314. The protrusion 316 in fact serves the same function as the tubular member 48 in the connector 32 and has a step 76 on its radially inner surface to form a valve seat or cylinder against which the O-ring 74 on the closure member 70 can seat.

The protrusion 316 extends with clearance through a sleeve 317 with an O-ring 319 being mounted in a complementary annular recess in the protrusion 316 and slidably and sealingly engaging the radially inner surface of the sleeve 317. A bleed passage 318 extends through the shoulder 314 to connect the cavity defined between the radially inner surface of the extension piece 302, the piston 304 and the shoulder 314 in flow communication with the bleed passage 78.

It is to be appreciated that in view of the fact that the O-ring 68 sealingly abuts the radially inner surface of the protrusion 316 the sleeve 317 is not necessary and could be omitted. The bleed passage 318 would also then not be necessary in view of the fact that the cavity defined between the radially inner surface of the extension piece 302, the piston 304 and the shoulder 314 would be in flow communication with the bleed passage 78 via the space between the radially outer surface of the protrusion 316 and the shoulder 314.

In use, the piston 54 of the connector 300 operates in exactly the same manner as the piston 54 of the connector 32 such that water pressure in the bridge piece 52 tends to displace this piston 54 against the bias of the spring 62 in the direction of arrow 88.

In contrast, the pressure of the water contained within the connecting piece 42 acting on the piston 304 displaces the piston against the bias of the coil spring 312 in a direction opposite to the direction of arrow 88. Accordingly, if the water pressure in the connecting piece 42 becomes too high the piston 304 is displaced in a direction opposite to arrow 88 thereby displacing the step 76 towards the closure member 70 which in turn restricts the flow of water through the member 316 reducing the water pressure in the bridge piece 52. This reduction of water pressure in the bridge piece 52 allows the piston 54 to be displaced under the action of the spring 62 in a direction opposite to the direction of arrow 88 thereby displacing the closure member 70 away from the step 76 and permitting an increase in the flow of water therebetween. Should the water pressure within the connecting piece 42 fall then the piston 304 is displaced under the influence of the coil spring 312 towards its rest position thereby further increasing the clearance between the step 76 and the closure member 70 permitting a further increase in the flow of water therebetween. If the increased flow in water results in an increase in water pressure in the bridge piece 52 then the piston 54 will be displaced in the direction of arrow 88 as described above. By adjusting the position of the sleeve 50 relative to the extension piece 302 the spacing between the closure member 70 and the step 76 when the pistons 54 and 304 are in their rest positions can be adjusted. Similarly, adjusting the position of the extension piece 302 relative to the connecting piece 42 has the same-effect. This arrangement enables the pressure to which water flowing through the connector 300 is regulated to be adjusted. Further, use of the two pistons 54, 304 enables the connector to supply water at a more or less constant pressure even in cases where the pressure of the main supply is not constant.

As with the connector 32 the connector or regulator 300 can be configured such that by adjusting the positions of the sleeve 50 relative to the extension piece 302 the O-ring 74 can be positioned sealingly within the valve cylinder 76 even when the pistons 54 and 304 are in their rest positions thereby to prevent the flow of water through the connector 300.

Reference is now made to FIGS. 7 to 10 of the drawings, where unless otherwise indicated, the same reference numerals used above are used to designate similar parts and where reference numeral 200 refers generally to liquid dispensing apparatus in accordance with the invention. The apparatus 200 includes an attachment 202 for attachment to a vessel in the form of a PET bottle 204 defining a pumping chamber and to a container 206 containing a liquid 208 to be dispensed. The attachment 202 comprises a body 203 of a synthetic plastics material. It is to be appreciated, however, that any suitable material could be used for the body. The apparatus 200 further includes a connector 32 for connecting the attachment 202 in flow communication with a pumping fluid such as a main water supply.

As mentioned above, the pumping chamber can be in the form of a PET bottle 204, the attachment 202 including an adaptor 210 mounted on the body 203 and sealingly mountable on the mouth of the bottle 204.

Figure 8:
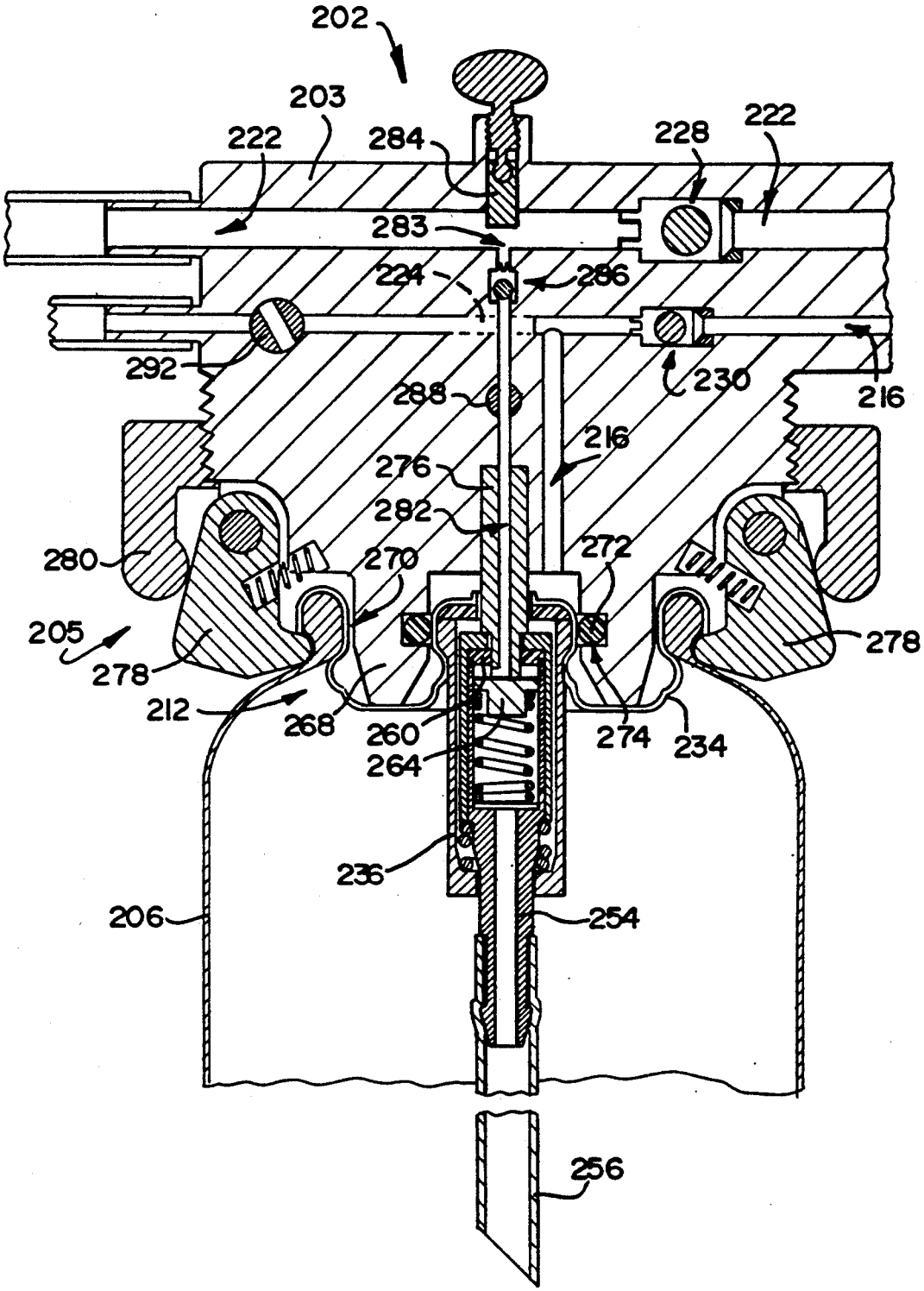
FIG. 8 shows, on an enlarged scale, a sectional elevation of part of the attachment forming part of the liquid dispensing apparatus of FIG. 7.

As can best be seen in FIG. 8 of the drawings, the container 206 is typically an unpressurized aerosol type container having an aerosol valve, generally indicated by reference numeral 212 mounted therein. The attachment 202 then includes an adaptor, generally indicated by reference numeral 205, mounted on the body 203 for engagement with the container 206 to open the aerosol valve 212 as described in more detail herebelow.

The attachment 202 includes an air flow passage 216 extending through the body 203 and connecting the bottle 204 and container 206 in gaseous communication. The attachment 202 further includes a pumping fluid or feed passage 218 which is connected via a hose-pipe 220 to the connector 32, The water feed passage 218 leads through the body 203 into the bottle 204 to feed water from the connector into the bottle 204 as described in more detail herebelow.

The attachment 202 also includes a connecting passage 222 which connects the water feed passage 218 in flow communication with a liquid discharge passage 282 as described in more detail herebelow- Further, an air bypass passage 224 extends through the body 203 and is in flow communication with the air flow passage 216.

A float actuated normally open non-return valve 226 is provided at the upstream end of the air flow passage 216.

Further, a non-return valve 228 is provided in the connecting passage 222 and a non-return valve 230 is provided in the air flow passage 216. If desired an anti-siphon device (not shown) can be positioned in the connecting passage 222.

Figure 9:
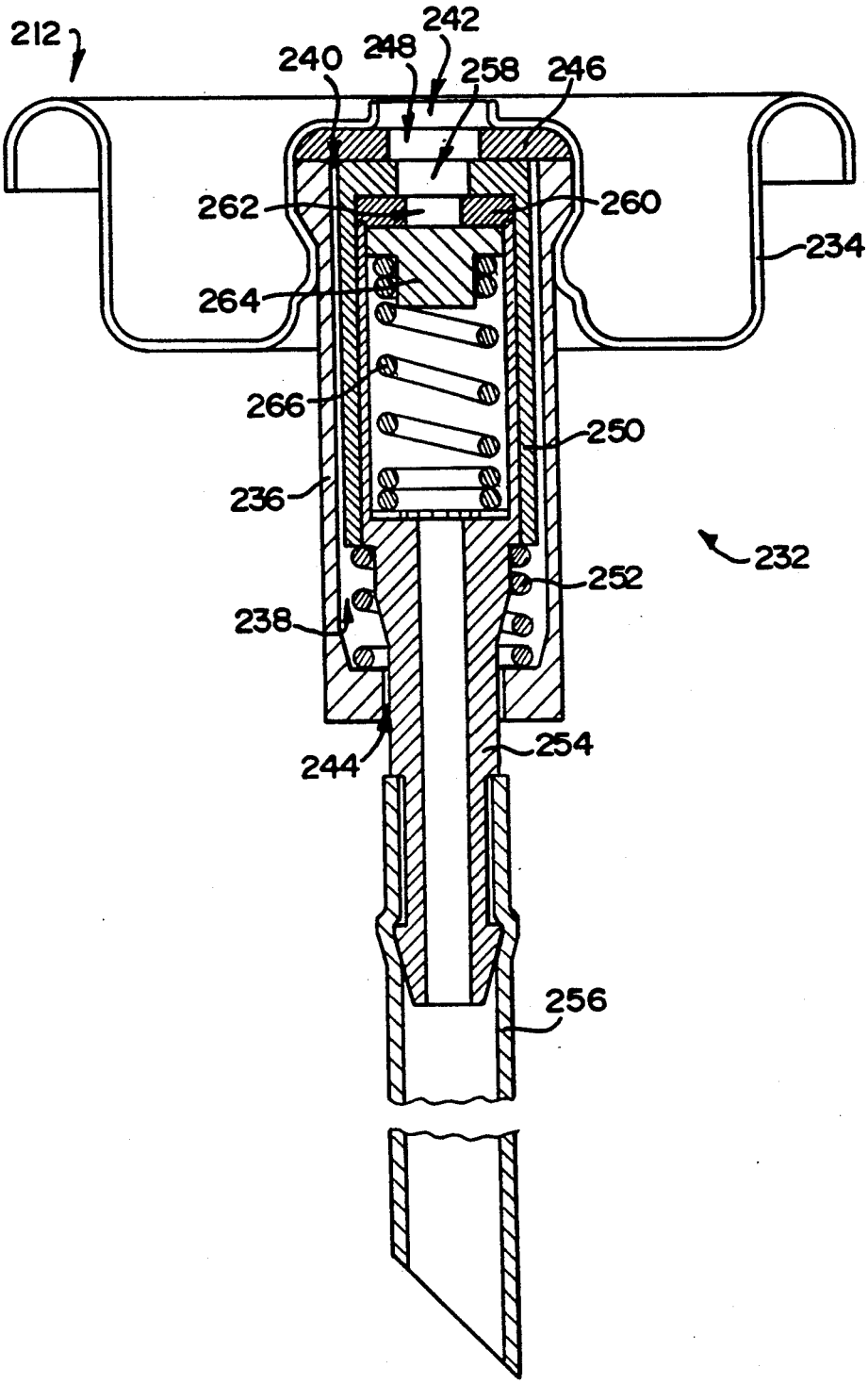
FIG. 9 shows, on an enlarged scale, a sectional elevation of an aerosol valve forming part of the liquid dispensing apparatus of FIG. 7.
Figure 10:
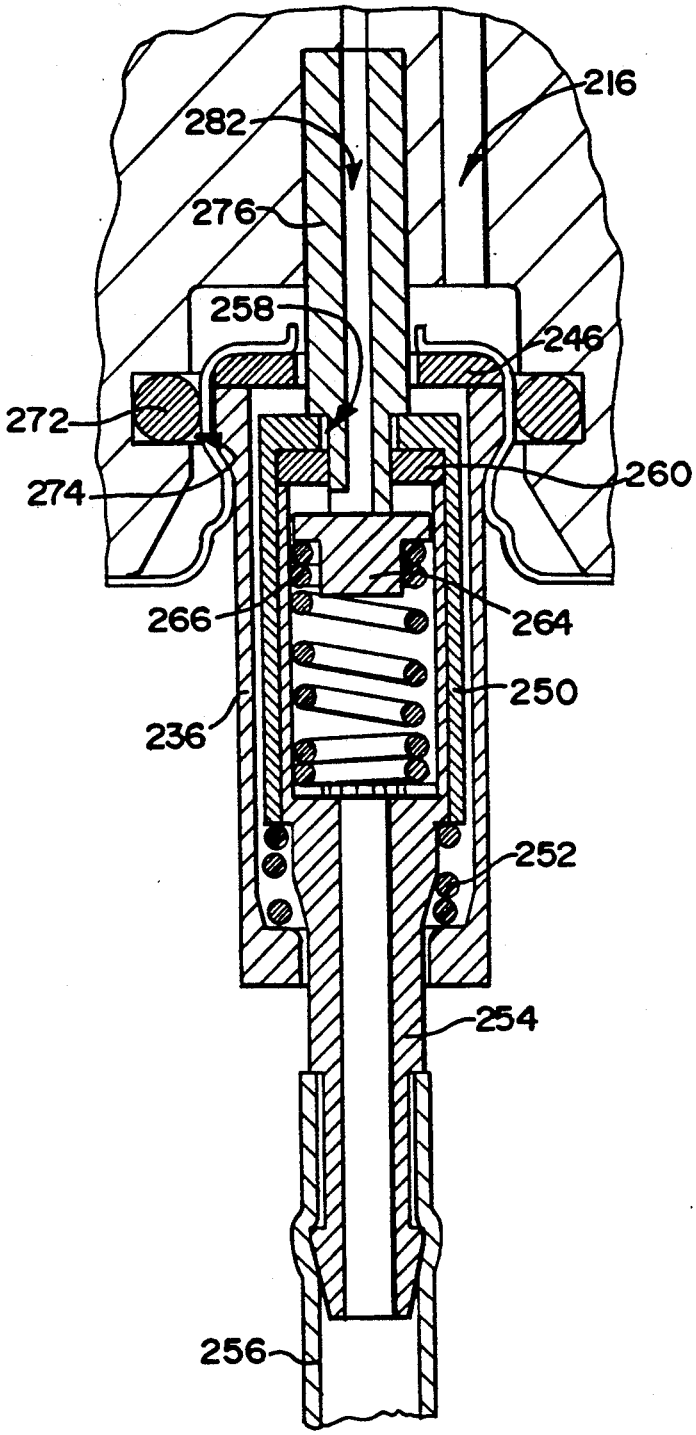
FIG. 10 shows a sectional elevation of the aerosol valve of FIG. 9 when the liquid dispensing apparatus is being used to dispense a liquid.

As can best be seen in FIGS. 8, 9 and 10 of the drawings, the aerosol valve 212 comprises a housing 232 which is mounted on the container 206. The housing 232 comprises a mounting cup or cap 234 which is mounted on the container 206, and a cylindrical sleeve 236 which is fast with the mounting cup 234. The sleeve 336 defines a cylindrical cavity 238 and has an open upper end 240 which is in register with a centrally positioned opening 242 in the mounting cup 234. Further, the sleeve 236 has an open lower end 244. An annular gasket 246 is sandwiched between the upper end of the sleeve 236 and the mounting cup 234 the gasket 246 having a hole 248 therethrough which is in register with and of smaller diameter than the opening 242 through the mounting cup 234.

A tubular piston 250 is mounted with radial clearance in the sleeve 236 and is displaceable between a normally closed position (shown in FIG. 9 of the drawings) in which it seats sealingly against the gasket 246 and an unseated position (shown in FIGS. 8 and 10 of the drawings). Bias means in the form of a coil spring 252 is provided in the sleeve 236 to urge the piston 250 towards its closed position. A tail piece 254 is connected to the piston 250 and protrudes through the open lower end 244 of the sleeve 236. A dip tube 256 is connected to the protruding portion of the tail piece 254 and extends to the bottom of the container 206.

The piston 250 has an open upper end 258 which is in register with the opening 242 and hole 248 and which is of smaller diameter than the hole 248. An annular seal 260 is mounted in the piston 250 adjacent its open upper end, the seal 260 having a hole 262 therethrough which is in register with and of smaller diameter than the open upper end 258 of the piston 250.

The aerosol valve 212 further includes a valve member 264 mounted in the piston 250 for displacement between a rest position (shown in FIG. 9 of the drawings) in which it abuts sealingly against the seal 260 and an open position in which it is spaced from the seal 260 with urging means in the form of a coil spring 266 being provided in the piston 250 to urge the valve member 264 towards its rest position.

As can best be seen in FIG. 8 of the drawings, the adaptor 205 includes an annular collar 268 which is receivable in a complementary annular recess 270 in the mounting cup 234. An O-ring 272 is mounted in a complementary annular recess 274 in the collar 268, the O-ring 272 sealingly engaging the mounting cup 234 when the collar 268 is mounted therein. In addition, the adaptor 205 includes a stepped spigot-like member 276 which extends co-axially with the collar 268.

The adaptor 205 includes retaining means in the form of three pivotally mounted pawls 278 which are arranged to engage the mounting cup 234 at equally circumferentially spaced positions and which are retained in position by means of a retaining collar 280 screw-threadedly mounted on the body 203. When the pawls 278 engage the mounting cup 234 the spigot-like member 276 protrudes through the seal 260 to unseat the valve member 264 and piston 250. The radially inner surface of the seal 260 sealingly abuts the spigot-like member 276. It is to be appreciated that the configuration of the adaptor 205 can be varied to suit different types of containers 206.

The liquid discharge passage 282 mentioned above extends through the spigot-like member 276 connecting the dip tube 256 and hence the interior of the container 206 in flow communication with the connecting passage 222. The intersection of the liquid discharge passage 282 and the connecting passage defines a mixing zone 283 in which water and liquid 208 are mixed as described in more detail below.

Dilution control means in the form of an adjustable gate 284 is mounted in the connecting passage 222 to permit the cross-section of the connecting passage 222 to be adjusted as desired. A non-return valve 286 is mounted in the liquid discharge passage 282 immediately upstream of its intersection with the connecting passage 222.

In use, water is fed through the connector 32, hosepipe 220 and through the water feed passage 218 into the bottle 204. Air contained within the bottle 204 is displaced by the water flowing into the bottle and flows through the non-return valves in the air flow passage 216 between the spigot-like member 276 and the mounting cup 234 through the space defined between the piston 250 and the sleeve 236 and through the open lower end 244 of the sleeve 236 into the container 206. The pressurized air in the container 206 urges the liquid 208 through the dip tube 356 and the tail piece 254 into the piston 250. From there the liquid flows around member 264 into the liquid discharge passage 282 through the spigot-like member from where it mixes with water flowing through the connecting passage 222. Hence, by adjusting the cross-section of the connecting passage 222 the water flow rate and hence the degree of dilution of the liquid 208 can be adjusted. A stop cock 288 is provided in the liquid discharge passage 282 to prevent the flow of liquid therethrough if desired.

The connecting passage 222 continues beyond the mixing zone 283 and its downstream end exits the housing 203 and can be connected to a dispensing device such as a lance 290.

The air bypass passage 224 can also be connected to the lance 290 to permit aeration of the diluted liquid being dispensed from the lance thereby to permit the liquid to be dispensed in the form of a fine spray. The lance 290 is trigger operated such that actuation of the trigger permits flow through the water discharge passage 222 and the air bypass passage 224.

A stop cock 292 is also provided in the air bypass passage 224 to selectively close or open the air bypass passage 224 as desired.

A non-return valve 291 in the air passage of the lance 290 prevents liquid from the liquid passage of the lance from entering the air passage when stopcock 292 is open and when the pressure in container 206 is lower than the pressure of the water passage of the lance 290.

The bottle 204 is dimensioned such that it contains sufficient air to dispense all of the liquid 208 contained within the container 206.

When the bottle 204 becomes almost full of water, the water closes off the float actuated valve 226 thereby preventing the flow of water through the air flow passage 216 into the container 206.

A pressure relief valve in the form of a spring loaded plug 293 is provided in a passage 295 which is in flow communication with the interior of the container 204. Hence, if the pressure within the container 204 should exceed a predetermined maximum pressure the plug 293 will be urged out of the passage 295 against the bias of the spring thereby venting the container 204 to atmosphere.

Figure 12:
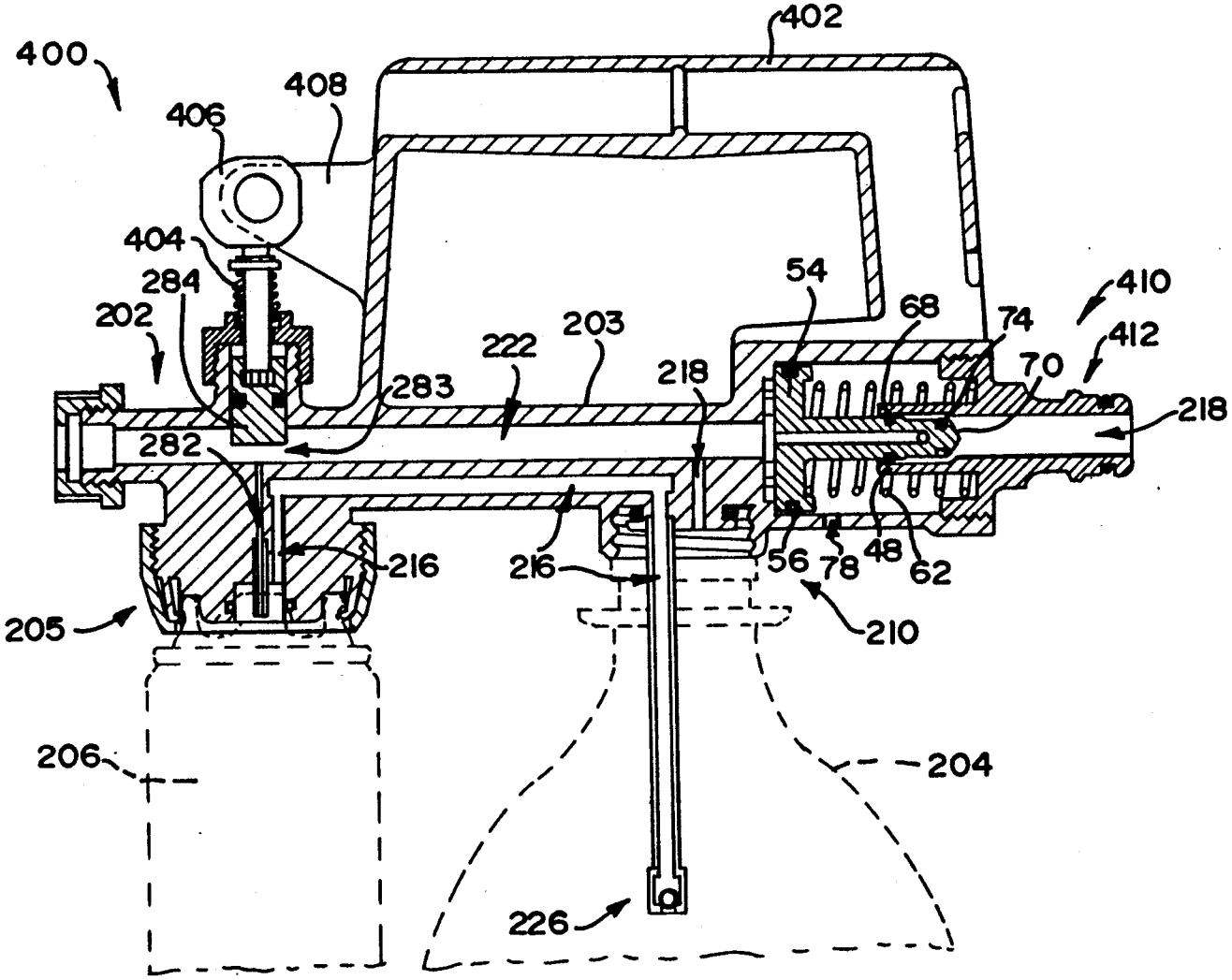
FIG. 12 shows a sectional elevation similar to FIG. 7 of part of another liquid dispensing apparatus in accordance with the invention, certain details having been omitted for the sake of clarity.

Reference is now made to FIG. 12 of the drawings, in which reference numeral 400 refers generally to another liquid dispensing apparatus in accordance with the invention. In FIG. 12 of the drawings, unless otherwise indicated, the same reference numerals used above are used to designate similar components. Further, in FIG. 12 of the drawings certain details have been omitted for the sake of clarity with the emphasis being placed on those features which distinguish the liquid dispensing apparatus 400 over the apparatus 200.

The apparatus 400 includes a handle 402 formed as an integral part of the body 203.

In contrast with the apparatus 200 in which the gate 284 is adjusted by means of an adjustment screw, in the apparatus 400 the gate 284 is resiliently biassed by means of a coil spring 404 towards a retracted position in which it is clear of the mixing zone 283. The gate 284 is displaced against the bias of the spring 404 into the mixing zone 283 by means of a cam 406 rotatably mounted between a pair of lugs 408 (one of which is shown in FIG. 12 of the drawings) protruding from the handle 402. The cam 406 is displaceable between four different positions, each of which results in the gate 284 protruding into the mixing zone 283 to a greater or lesser extent and thereby serving to adjust the dilution of the liquid being fed through the liquid discharge passage 282 into the connecting passage 222.

In addition, a connector, generally indicated by reference numeral 410, defines the inlet of the water feed passage 218. The connector 410 defines a male member 412 which is substantially identical to the male member 38 (FIG. 2 of the drawings) and is click-lockingly engageable by means of a garden irrigation fitting having a complementary female fitting. The connector 410 incorporates a pressure regulator which operates in substantially the identical fashion to the pressure regulator of the connector of FIG. 2 of the drawings and serves to regulate the pressure of water flowing into the bottle 204.

In the apparatus 400, the adaptor 210 is in the form of a screw-threaded socket into which the mouth of a PET bottle is mountable.

The apparatus 400 is used in substantially the identical manner to the apparatus 200. The handle 402 facilitates carrying of the apparatus 400.

The Applicant believes that the liquid dispensing apparatus will be particularly suitable for dispensing substances such as pesticides. In particular, the Applicant believes that the light weight of the apparatus will render it easily portable enabling it to be used for domestic applications such as applying pesticides in a garden.

Further, the Applicant believes that an advantage of the liquid dispensing apparatus is that the liquid to be dispensed can be mixed automatically in the desired proportion with the water passing through the water discharge passage. This is in contrast with other dispensing apparatus of which the Applicant is aware which requires the dilution of the liquid manually by pouring it into a container and then adding the desired amount of water. This is inconvenient and undesirable particularly in the case of poisonous liquids which may come into contact with the skin of a person. Further, the Applicant believes that the low cost of the apparatus in comparison with other dispensing apparatus known to the Applicant, will make it more readily available to a greater number of people which together with its comparative convenience of use will increase the amount of spraying which may be carried out this reducing the damage done by pests.

In addition, no physical effort is required to pressurize the liquid container of the present invention and in addition the pressure within the container remains constant or nearly constant. In contrast, dispensing systems of which the Applicant is aware require the activation of a manual pump to pressurize liquid container and the pumping must be done either on a continuous or an intermittent basis and as a result variations in pressure and thus efficiency with regard to application rate and droplet size may occur.

A further advantage of liquid dispensing apparatus in accordance with the invention is that air may be mixed with the liquid to achieve a small droplet size for increased efficiency of spray and for better wetting efficiency around foliage and the like. Further, because of the automatic in-line mixing system spraying may be terminated at any suitable time and no excess liquid will have been mixed, which will obviate the problem of wastage and what to do with any excess liquid which may also cause environmental problems.

The Applicant believes that the liquid dispensing apparatus will be particularly suitable for the recharging of aerosol containers with compressed air using the aerosol valve 212 which operates both as a charge and a discharge valve. The aerosol could be used in the normal manner by disconnecting the aerosol from spigot-like member 276 and fitting a normal type male aerosol button. Instead, the aerosol may remain connected to spigot-like member 276 and be continuously charged to maintain it at a constant or nearly constant pressure in which case water may be shut-off at 228 (FIG. 8) and pure undiluted liquid 208, such as deodorants and the like, may be dispensed through a normal aerosol button as an extension of passage 282.

In addition, liquid dispensing and air mixing apparatus may be linked to an automatic garden or crop spraying system for dispensing pesticides or fertilizer and the like or for introducing air to the system to achieve a finer spray for more efficient coverage of foliage or ground and may be used to aerate the water for more efficient plant growth properties.

In addition, the system may be used to dispense bath oils, shampoo, soap and the like in a shower or bath. And the air mixing system .may be used to obtain a fine spray in the shower for economies of water consumption and the reduced droplet size will enable the use of water hotter than normally used in a shower thus providing a facility similar to a steam bath.

Further, the system may be used to dispense toilet cleansers or sanitizers into toilet cisterns or into closed systems or instant open and close toilet and urinal flushing systems one of which is sold under the brand name "Castle". This will obviate the need for unsightly blocks or balls of material in toilet bowls and urinals. This is in contrast to systems of which the Applicant is aware which require the insertion by hand of protruding apparatus which is unattractive and which provides an impediment to the workings of the mechanism of a toilet system.

What is claimed is:

1. Liquid dispensing apparatus comprising:

an attachment sealingly attached or attachable to a vessel defining a pumping chamber and to a container containing liquid to be dispensed, the attachment including communication means for establishing gaseous communication between the pumping chamber and the container;

a discharge passage for conducting liquid from said container to a discharge zone;

connecting means for connecting a supply of pumping fluid in flow communication with said pumping chamber so as to feed pumping fluid into the pumping chamber and thereby displace air in the pumping chamber along the communication means into the container to pressurize the container and discharge the liquid contained in the container through the discharge passage; and pressure regulating means for regulating the pressure of fluid entering the pumping chamber.

2. Liquid dispensing apparatus as claimed in claim 1, in which the attachment comprises a body, a first adaptor mounted on the body to which the vessel defining the pumping chamber is attached or attachable, a second adaptor mounted on the body to which the container containing liquid to be dispensed is attached or attachable, an air flow passage extending through the body to connect the pumping chamber in gaseous communication with the container, a pumping fluid feed passage extending through the body and having an inlet which is connectable to a supply of pumping fluid and an outlet positioned to feed pumping fluid into the pumping chamber, the discharge passage extending through the body and having an inlet end through which liquid can enter the discharge passage and a discharge end.

3. Liquid dispensing apparatus as claimed in claim 3, in Which the attachment defines a mixing zone for mixing liquid dispensed from said container with a diluent.

4. Liquid dispensing apparatus as claimed in claim 3, which includes dilution control means mounted in the vicinity of the mixing zone to permit adjustment of the degree of dilution of the liquid being dispensed.

5. Liquid dispensing apparatus as claimed in claim 4, in which the dilution control means comprises an adjustable gate mounted in the mixing zone to adjust the flow of pumping fluid flowing through the mixing zone.

6. Liquid dispensing apparatus as claimed in claim 3, which includes a connecting passage extending through the body and connecting the pumping fluid feed passage in flow communication with the liquid discharge passage upstream of the discharge end of the liquid discharge passage, the intersection between the connecting passage and the liquid discharge passage defining said mixing zone.

7. Liquid dispensing apparatus as claimed in claim 2, in which the connecting means includes a connector mounted on the body and defining the inlet of the pumping fluid feed passage, the connector including a connecting formation whereby it is disconnectably connectable to a pumping fluid supply conduit.

8. Liquid dispensing apparatus as claimed in claim 7, in which the pressure regulating means is contained within the connector.

9. Liquid dispensing apparatus as claimed in claim 2, in which the connecting means includes a connector connected to the inlet of the pumping fluid feed passage by means of a flexible conduit.

10. Liquid dispensing apparatus as claimed in claim 9, in which the pressure regulating means is contained within the connector.

11. Liquid dispensing apparatus comprising:

an attachment sealingly attached or attachable to a vessel defining a pumping chamber and to a container for containing a liquid to be dispensed, the attachment including communication means for connecting the pumping chamber and the container in gaseous communication;

means defining a mixing zone;

a discharge passage connecting the container in flow communication with the mixing zone; and a connecting means for connecting a supply of pumping fluid in flow communication with the pumping chamber so as to feed pumping fluid into the pumping chamber and thereby displace air from the pumping chamber along the communication means into the container to pressurize the container and discharge the liquid from the container along the discharge passage to the mixing zone for mixing with a diluent prior to being dispensed.

12. Liquid dispensing apparatus as claimed in claim 11, further comprising a diluent feed lien for connecting a supply of diluent in flow communication with the mixing zone.

13. Liquid dispensing apparatus as claimed in claim 12, in which the attachment comprises a body, a first adaptor mounted on the body to which the vessel defining the pumping chamber is attached or attachable, a second adaptor mounted on the body to which the container for containing liquid concentrate to be dispensed is attached or attachable, in air flow passage extending through the body to connect the pumping chamber in gaseous communication with the container, a pumping fluid feed passage extending through the body and having an inlet which is connectable to a supply of pumping fluid and an outlet positioned to feed pumping fluid into the pumping chamber, the discharge passage extending through the body and having an inlet end through which liquid concentrate can enter the discharge passage and a discharge end.

14. Liquid dispensing apparatus as claimed in claim 13, in which the diluent feed line comprises a connecting passage extending through the body and connecting the pumping fluid feed passage in flow communication with the liquid discharge passage upstream of the discharge end of the liquid discharge passage, the intersection between the connecting passage and the liquid discharge passage defining said mixing zone wherein liquid can be mixed with a diluent in the form of pumping fluid flowing through the connecting passage.

15. Liquid dispensing apparatus as claimed in claim 14, further comprising dilution control means whereby the degree of dilution of the liquid is adjustable.

16. Liquid dispensing apparatus as claimed in claim 14, in which the dilution control means comprises a gate adjustably mounted on the body to permit the flow of diluent flowing through the mixing zone to be adjusted.

17. Liquid dispensing apparatus as claimed in claim 11, further comprising pressure regulating means for regulating the pressure of fluid entering the pumping chamber.

* * * * *